US008020417B2

(12) United States Patent
Karam et al.

(10) Patent No.: US 8,020,417 B2
(45) Date of Patent: Sep. 20, 2011

(54) METHOD AND DEVICE FOR CONTROLLING A ROLLED PRODUCT THICKNESS AT A TANDEM ROLLING MILL EXIT

(75) Inventors: Michel Abi Karam, Courbevoie (FR); Stéphane Gouttebroze, Precieux (FR)

(73) Assignee: Siemens VAI Metals Technologies SAS, Saint-Chamond (FR)

( * ) Notice: Subject to any disclaimer, the term of this patent is extended or adjusted under 35 U.S.C. 154(b) by 485 days.

(21) Appl. No.: 11/922,519

(22) PCT Filed: May 24, 2006

(86) PCT No.: PCT/FR2006/001199

§ 371 (c)(1),
(2), (4) Date: Apr. 15, 2008

(87) PCT Pub. No.: WO2006/136670

PCT Pub. Date: Dec. 28, 2006

(65) Prior Publication Data

US 2009/0031776 A1 Feb. 5, 2009

(30) Foreign Application Priority Data

Jun. 23, 2005 (FR) ..... 05 06425

(51) Int. Cl.
*B21B 37/48* (2006.01)

(52) U.S. Cl. ..... 72/8.6; 72/10.3; 72/11.8

(58) Field of Classification Search ..... 72/8.6, 72/9.2, 9.4, 10.3, 10.4, 10.7, 11.4, 11.8, 12.3, 72/12.8, 205, 234; 700/151, 152
See application file for complete search history.

(56) References Cited

U.S. PATENT DOCUMENTS

| | | | | |
|---|---|---|---|---|
| 3,580,022 | A * | 5/1971 | Waltz et al. | 72/10.3 |
| 4,222,254 | A * | 9/1980 | King et al. | 72/10.4 |
| 4,521,859 | A * | 6/1985 | Fapiano | 700/156 |
| 4,648,257 | A * | 3/1987 | Oliver et al. | 72/9.2 |
| 4,691,547 | A * | 9/1987 | Teoh et al. | 72/9.2 |
| 4,905,491 | A * | 3/1990 | Starke et al. | 72/8.6 |
| 5,101,650 | A * | 4/1992 | Fapiano | 72/9.2 |
| 5,181,408 | A * | 1/1993 | Yeh et al. | 72/14.1 |
| 5,495,735 | A | 3/1996 | Nishimura et al. | |
| 5,799,526 | A | 9/1998 | Mieze et al. | |
| 6,263,714 | B1 * | 7/2001 | Johnson et al. | 72/9.2 |
| 2004/0221633 | A1 | 11/2004 | Abi-Karam | |

FOREIGN PATENT DOCUMENTS

| | | |
|---|---|---|
| FR | 2735046 A1 | 12/1996 |
| JP | 03 042109 | 2/1991 |
| JP | 5142523 A | 6/1993 |
| JP | 05 293523 | 11/1993 |
| JP | 08 323408 | 12/1996 |

* cited by examiner

*Primary Examiner* — Edward Tolan
(74) *Attorney, Agent, or Firm* — Laurence A. Greenberg; Werner H. Stemer; Ralph E. Locher

(57) ABSTRACT

A method and device for controlling the final thickness of a rolled product at a tandem rolling mill exit which make it possible to remove the cyclic defects of the product thickness variation. The method includes using at least one rolling stand provided with hydraulic adjustment devices located on the tandem rolling mill exit and in compensating the cyclic defects of the product thickness variation generated upstream through the entire rolling mill on the stand with the aid of an adjuster (R) coordinated with the frequency of defects. The method and device are suitable for tandem cold rolling mills producing metal strips. The thickness defects are detectable by a thickness sensor.

18 Claims, 3 Drawing Sheets

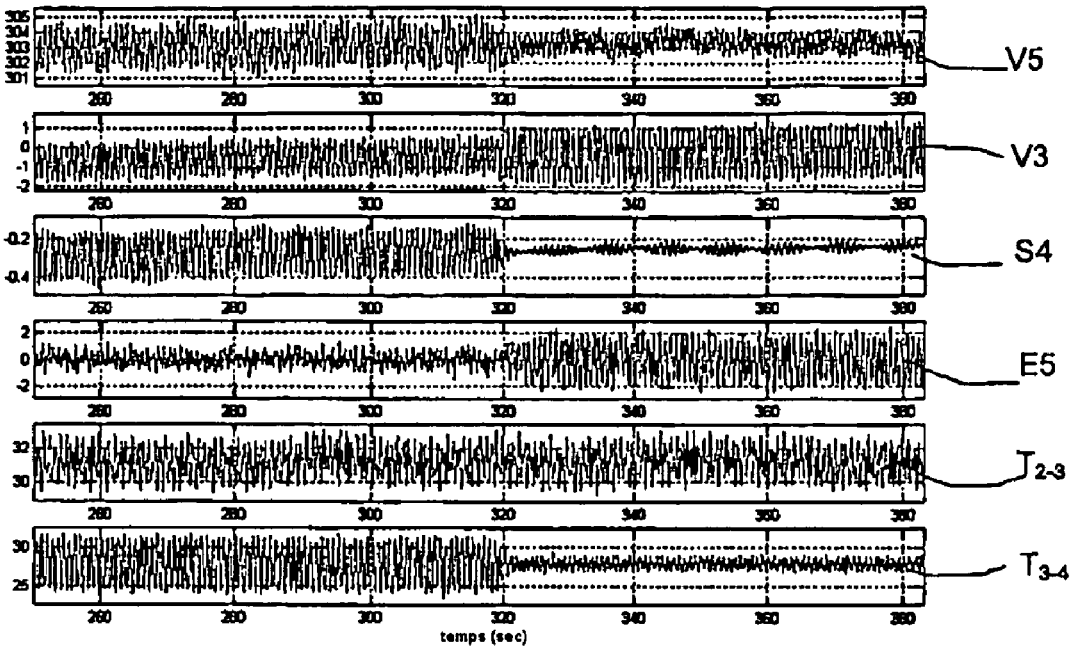
Fig. 5a Fig. 5b
Fig. 5
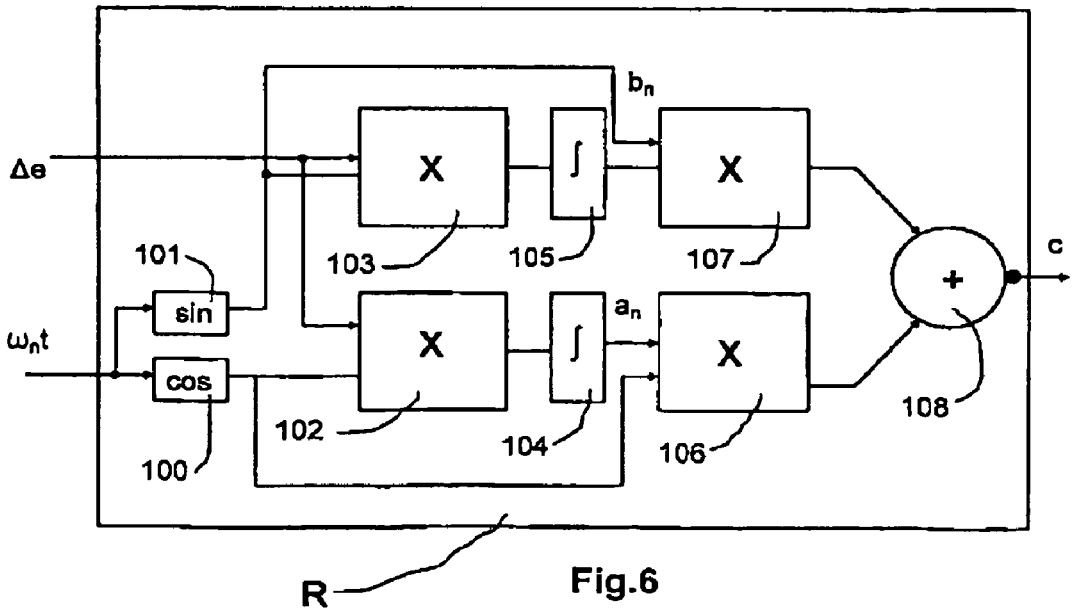
Fig.6

METHOD AND DEVICE FOR CONTROLLING A ROLLED PRODUCT THICKNESS AT A TANDEM ROLLING MILL EXIT

BACKGROUND (1) Field of the Invention

The invention relates to a method and a device for controlling the final thickness of a rolled product, at the exit of a tandem rolling mill, adapted to eliminate cyclic defects of variation of the thickness present in the product. In particular, the method eliminates the cyclic defects generated by the rolling mill stands, the defects of the rolls and their mounting in the bearings, the defects of false round and of non-circularity of the rolling rolls.

The invention applies in particular to cold tandem rolling mills for rolling metal strips, for example steel, but can be applied in general to any mill comprising several rolling stands operating in tandem for progressive reduction of the thickness of a product passing successively between the working rolls of said stands.

(2) Prior Art

It is known that a rolling mill comprises, in general, at least two working rolls mounted inside a support stand and defining an airgap for passage of product to be rolled, the stand bearing means for application of an adjustable clamping effort between the rolls. The number of rolls can vary according to the type of rolling mill, for example duo, quarto, sexto, according to whether it comprises a stack of two, four or six rolls to apply the clamping effort to the rolled product, or even other types of rolling mill.

These rolls are mounted to rotate in bearings known as chocks which may slide vertically inside the support stand to allow reclamping of said rolls and application of clamping effort to the product. Such an arrangement is well known and since it has been explained in numerous patents, it is not necessary to describe it further.

When mounting the rolls in these bearings presents defects due to the rolls or to their mounting in the bearings, or significant or irregular wear, concentricity defects, or even if the rolls themselves have a circularity defect, the result is a rotation of the rolls which is not perfectly circular, creating artificial and parasitic variation of the clamping effort.

To allow the product to pass between the rolls and a reduction in thickness, the said rolls are driven in rotation about their axis by motor means which apply a drive torque either directly to the working rolls, or indirectly to the support rolls or to the intermediary rolls in the case of quarto or sexto mounting.

Rolling mills known as <<in tandem", comprising at least two successive stands each contributing to part of the reduction in thickness, have been known for some time now. From its raw thickness on entry to the first stand the product undergoes initial reduction in thickness in the first stand, and exits from there at a speed determined by the rotation speed of the working rolls of this stand. In the second stand it undergoes a second reduction in thickness and exits from there at a higher speed to respect the law of conservation of the mass flow rate. The working rolls of the second stand must be driven in rotation at a speed greater than that of the rolls of the first stand, the ratio of the speeds between the first and the second stand being in the inverse ratio of the reduction in thickness made by the first stand. This is how it happens from stand to stand according to the total number of rolling stands the tandem rolling mill comprises.

Also, the rotation torques applied to the working rolls are adjusted such that each stand exerts a traction on the strip leaving the preceding stand. To obtain the requested final thickness it is necessary to control on one hand the reduction of the thickness made in each of the rolling stands in order to get, at the exit of the mill, a product having a constant thickness with a certain degree of precision, and also to keep the strip perfectly tightened in each space known as "inter-stand" between two successive stands, so as to avoid reaching traction levels which would risk causing the strip to break.

Normally, monitoring the thickness of the strip as it passes through the successive stands of a tandem rolling mill is ensured by the monitoring of the mass flow rate, otherwise called "mass flow".

Controlling the thickness of the tandem train is ensured so as to obtain a perfectly constant thickness of the strip at the exit of the mill, and for this it was imagined for a long time to maintain at a constant value on one hand the thickness of the strip at exit of the first stand, and on the other hand, the ratio of the speeds of the first and last stands.

The speeds of the intermediary stands can be deduced from these conditions as they are imposed by the law of conservation of the masses of metal passing through the stands of the rolling mill, and they are in the inverse ratio of the reductions to be attributed to each rolling stand. Controlling the thickness at the exit of the first stand is generally ensured, on a modern rolling mill, by a hydraulic clamping device which is controlled by a thickness gauge situated downstream of this stand. Certain more refined systems also comprise a thickness gauge upstream of this stand.

But systems for controlling thickness had been installed at a time when the clamping means of the rolls were constituted by electromechanical screw and bolt systems and adjusting was done by acting on the motors controlling rotation of the screws. Such tandem rolling mills have often been modernised by replacing the screw and bolt systems by hydraulic controls of which the position control precision and response time performances are superior. Yet mixed mills are still found, comprising, according to the stands, the two devices. All these clamping devices and their variants have been widely described and there is no need to do so further here.

The classic system for controlling of the thickness in the tandem rolling mill described earlier is currently called <<automatic gage control>> or AGC.

With this system it is thus not possible to act on the rotation speeds of the rolls of the stands to adjust the traction of the strip in the inter-stand intervals, without affecting the thickness at exit. The clamping devices of the stands are generally used to adjust the traction of the strip. Traction-measuring devices, generally constituted by an inter-stand rolling mill tensiometer, are installed for this purpose, which act to control the clamping means of the stand situated downstream. A thickness gauge placed at the exit of the rolling mill monitors the final thickness by acting on the speed of the last one or two stands of the tandem rolling mill. The inter-stand traction control system is also called <<automatic tension control>> or ATC.

Such controlling schemas would function perfectly with rolling stands which would present no mechanical defect, and in particular no defect in application of the clamping effort on the rolled product during rotation of the rolls. All these mechanical assemblies can have defects in mounting, adjustment, or even irregular wear which would create thickness defects in the product. In fact, these roll defects vary the clamping force on the product because, considering the variation in the value of their diameter throughout one rotation, the distance between the clamping force application means and the product is not constant. Everything happens as if adjusting the position of these clamping means were being changed, causing variation in the force applied, and due to this a variation in the thickness of the product. This thickness defect is cyclic and its frequency corresponds to that of the rotation of the roll. There would thus be relatively slow variations in thickness along the rolled product, corresponding to the eccentricity defects of the large-diameter support rolls, and faster variations corresponding to the circularity defects of the working rolls of smaller diameter.

Methods and devices for compensating for the effect on the thickness of the false round defects of the rolls were envisaged. These methods consist of determining a signal representative of the thickness defect caused by a support roll or a working roll. In general, processing by frequential analysis of the signal of the thickness gauge is carried out to extract variations corresponding to such or such roll of such stand, by tuning the frequency of the processing device to that of said stand. In more elaborate methods it was noticed that the false round signal of the rolls could also be extracted from that of the inter-stand traction measurement. French patent FR 2 735 046 to the applicant company accordingly proposes a method for compensation of the eccentricity defects of the rolls of a stand determined by generating a signal from measuring the traction in the strip upstream of this stand. Next, the compensation signal is used to correct adjustment of the clamping means of said stand.

Even though this method can be used to compensate the defects of all the rolls, it has been used primarily to compensate the defects of the support rolls. This is due to the fact that, considering their considerable diameter the rotation frequency is relatively low, of the order of a few hertz, to around 10 hertz. Now, these defects are detected by a thickness gauge of which the measurement is filtered. In fact, these gauges, generally by radiation, have a dispersion which translates by a background noise, the filtering of which is useful for making it easier to execute and adjust controlling. Typically, the filter of a thickness gauge is a low-pass filter of which the cutting frequency is regulated in the vicinity of 8 hertz. Because of this the defects due to the working rolls of which the diameter is around three times less that that of the support rolls remain unseen for most of the time at a high rolling speed.

SUMMARY OF THE INVENTION

The applicant noticed that in spite of placing eccentricity compensation of the type mentioned previously, thickness defects would appear at low speeds, principally linked to the rotation frequency of the working rolls. In fact, these defects are always present, but are simply masked by the filter of the thickness gauge at higher rolling speeds. The required tolerances in thickness are tighter and tighter and are currently of the order of 0.7% of nominal thickness. By way of example steel sheet for deep drawing has a thickness of the order of 0.25 millimetres, such tolerance requires monitoring of an absolute value of 1.75 micrometres, which can correspond to circularity defects of the rolls. The producer of sheet metal must guarantee the thickness of the product which he makes and carry out checking using the installed gauges. On the contrary, the user of these sheets who will make drawn parts for example could observe fabrication defects, linked to thickness defects, by other checking means. It is accordingly of major importance to find compensation means for these masked defects.

The applicant has ascertained that eccentricity compensation carried out conventionally according to the prior art, as in FIG. 3, remains without effect on certain types of defects. Therefore, such compensation can method only those defects which can be qualified as 'vertical mode', that is, caused by parasitic movements of the rolls in a vertical plane. They can be corrected by application of the compensation signal to the stand which generates these defects. Or, the residual defect observed results from defects of 'horizontal mode'. In fact, the rotation defects, particularly of the working rolls, engender variations in traction upstream and traction downstream of a determined stand.

The experience of the applicant showed that compensation of this type of defect based on the traction signal upstream and acting on the clamping of the stand itself does not compensate the resulting defect on the final thickness.

Compensation of this defect of "horizontal mode" by action on the tractions by means of the drive motors could thus be imagined. But in general the response times of these motors are much too high to be able to have an action, at high rolling speeds, on the defects linked to the rotation frequency of the working rolls. Other compensation means of the defects of a determined stand were thus imagined, by action on the clamping means of another stand, situated downstream, by means of a regulator connected to the frequency of the defect to be corrected.

According to the method of the invention at least one stand equipped with hydraulic clamping means is used, and compensation is used, on this stand of all the defects of "horizontal mode" generated on the entire rolling mill. In the method of the invention hydraulically controlled clamping means installed on at least the last stand of the mill are used to create, according to the control method, compensation of the cyclic perturbations of the thickness present in the strip and likely to be measured on the tandem rolling mill, by action on said hydraulically controlled clamping means, by means of a regulator tuned to the frequency of said cyclic defect.

According to the method of the invention the cyclic defects present in the strip are detected by a thickness gauge, in general originate from the mechanical defects of the rolling mill stands and in particular from the defects of false round and eccentricity of the rolling rolls.

Still according to the method of the invention the cyclic perturbations of the thickness of the product caused by the eccentricity defects of the rolls of the stand of row i are compensated by the action of the clamping device on the hydraulic adjustment of at least one stand situated downstream of said stand of row i. The defects generated by the stand of row i are preferably compensated by action of the controlling device on the hydraulic adjustment of the stand situated downstream and the closest to said stand of row i, for which there is a hydraulically controlled clamping device and a thickness gauge situated at its exit. Yet it is also possible, according to the method of the invention, and according to the rolling stand equipment, to compensate the cyclic defects of the thickness of the product caused by the eccentricity defects of the rolls of the first stands of the tandem rolling mill by action of the controlling device on the hydraulic adjustment of the last stand of said tandem rolling mill. Finally, the cyclic perturbations of the thickness of the product caused by the eccentricity defects of the rolls of the last stand of the tandem rolling mill are also compensated by the action of the controlling device on the hydraulic adjustment of said last stand of the tandem rolling mill, according to the method of the invention.

A device for controlling the thickness of the strip at the exit of a rolling mill constituted by at least two stands operating in tandem according to the invention comprises adjustable clamping means of the rolling rolls, including hydraulically controlled means on at least the last stand, the mill being connected to an automatic device for controlling exit thickness and tension of the product in each space between two successive stands, and to a general device for monitoring of the speeds of the set of rolling mill stands, said device for controlling the thickness also comprising at least one compensation circuit of the cyclic perturbations of the thickness present in the rolled strip, acting in closed loop and in real time on the hydraulically controlled clamping means by forming a compensation signal from the signal from a thickness gauge.

The device for controlling the thickness of the strip according to the invention is designed to correct in particular the cyclic defects of the thickness of the strip of which the origin is mechanical defects of the stands of the tandem rolling mill. The compensation devices of the invention comprise a resonating circuit tuned to the frequency of the cyclic defect to be corrected. The compensation devices of different cyclic defects comprise resonating circuits each tuned to the frequency of one of the cyclic defects to be corrected. In a device for controlling the thickness of the strip according to the invention, the compensation devices of the cyclic defects of the stand of row i act on the hydraulic clamping of the first stand situated downstream of said stand of row i equipped with such adjusting means of the clamping of the rolling rolls, as well as a thickness gauge at the exit of said rolling mill stand situated downstream of said stand of row i.

According to another embodiment of the invention compensation devices of the cyclic defects of the first stands of the tandem rolling mill all act on the hydraulic clamping device of the last stand of the tandem rolling mill by using the signal of the exit thickness gauge of the tandem rolling mill and comprise resonating circuits tuned to the frequency of the cyclic defect of each of the first stands of the tandem rolling mill to be compensated. The resonating circuit of the compensation device of the invention comprises a Fourrier analyser operating in real time on the fundamental frequency of the signal of the thickness gauge.

In a rolling mill according to the invention, comprising at least two rolling mill stands operating in tandem, equipped with adjustable clamping means of the rolling rolls, the mill being linked to an automatic device for controlling the exit thickness and tension of the product in each space between two successive stands, and to a general device for monitoring the speeds of the set of rolling mill stands, there are hydraulically controlled means on at least the last rolling stand for clamping the rolls and at least one compensation circuit of the cyclic perturbations of the thickness present in the rolled strip, acting in closed loop on the hydraulically controlled clamping means.

A rolling mill according to the invention comprises at least one exit thickness gauge providing the measuring signal used by the compensation circuits.

BRIEF DESCRIPTION OF THE DRAWINGS

But the invention will be better understood from the description of an embodiment.

FIG. 5 shows a recording of an assay of compensation according to the invention.

FIG. 6 shows a block diagram of the resonating circuit according to the invention.

FIG. 1 schematically shows a tandem rolling mill with four stands 1, 2, 3, 4 of quarto configuration, of which each stand is equipped with two working rolls 11, 12, 21, 22, and two support rolls 13, 14, 23, 24 . . . . The rolled product, constituted by a metal strip B circulates from stand 1 to stand 4 according to the travel direction F and its thickness is progressively reduced by each of the stands 1, 2, 3, 4.

DETAILED DESCRIPTION OF THE PREFERRED EMBODIMENT(S)

Figure 1:
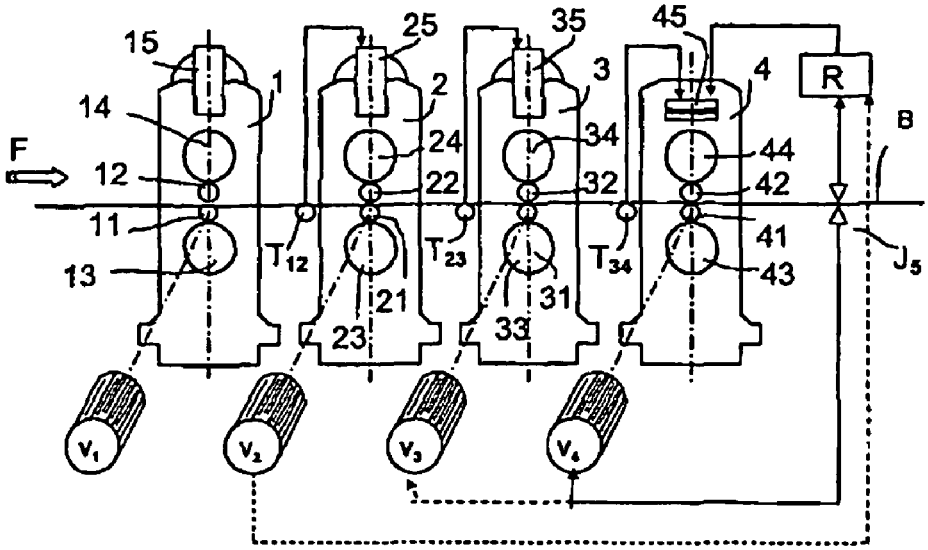
FIG. 1 shows a tandem rolling mill with 4 stands in minimal configuration for executing the invention.

The clamping means of the stands 1, 2 and 3 are screw-and-bolt systems 15, 25, 35 of which the screw is motorised by a motor, not shown here, such that it can act on the clamping effect of the rolls. The stand 4 is equipped with hydraulic adjustment means 45, the rolling mill comprises an exit thickness gauge $J_5$ for monitoring the exit thickness, by action on the motor of stand 4, or on the two motors of stands 3 and 4, according to a well known operating mode of the thickness control of a tandem rolling mill of AGC type. Devices for measuring traction with tensiometer rolls $T_{12}$, $T_{23}$, $T_{34}$, are installed between each stand and each of them acts on the clamping device of the stand situated immediately downstream so as to keep the traction in the strip constant in application of the law of the conservation of flow.

Figure 2:
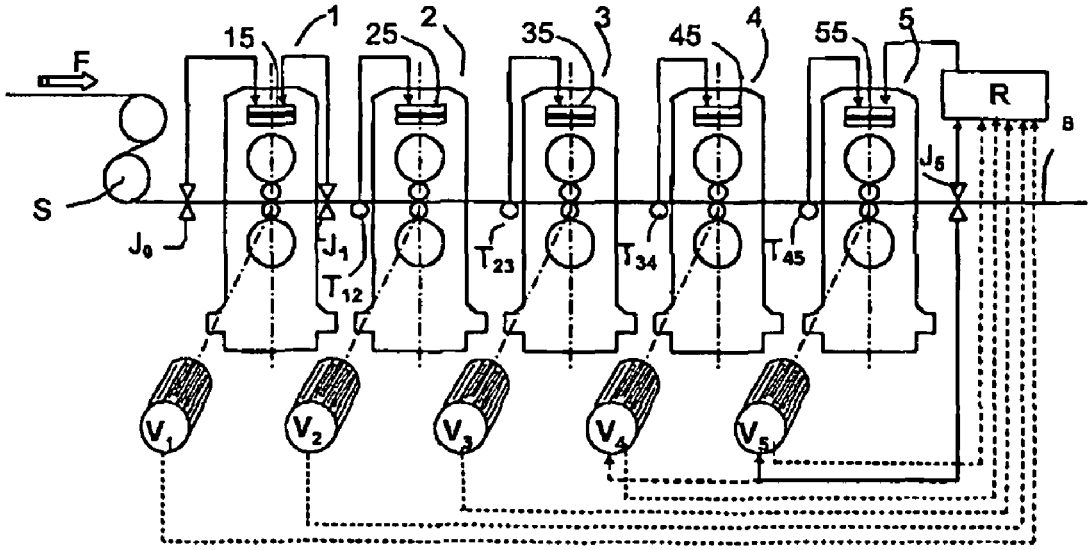
FIG. 2 shows a modern tandem rolling mill with 5 stands for executing the invention.

FIG. 2 schematically shows a configuration of a modern tandem rolling mill with five stands 1, 2, 3, 4 and 5; all are equipped with hydraulic clamping means 15, 25, 35, 45 and 55 with a low response time, and are in quarto configuration. Illustrated is a continuous tandem rolling mill equipped with a tensioner device S at entry of the first stand. The general scheme of the thickness control of AGC type is classic, of the same type as that shown in FIG. 1. However, control of the first stand is more elaborate and comprises an upstream control with an entry thickness gauge Jo and a downstream control with a thickness gauge $J_1$ arranged downstream of the stand 1. Of course, an exit sensor $J_5$ monitors the final thickness at the exit of the mill by action on the motors of the last stands. Devices for measuring traction in the strip B, constituted by tensiometer rolls $T_{12}$, $T_{23}$, $T_{34}$ and $T_{45}$ ensure constant traction in the inter-stand intervals by acting respectively on the clamping means 25, 35, 45 and 55, each on the stand situated downstream of the measuring device, again in application of the law of flow.

Figure 3:
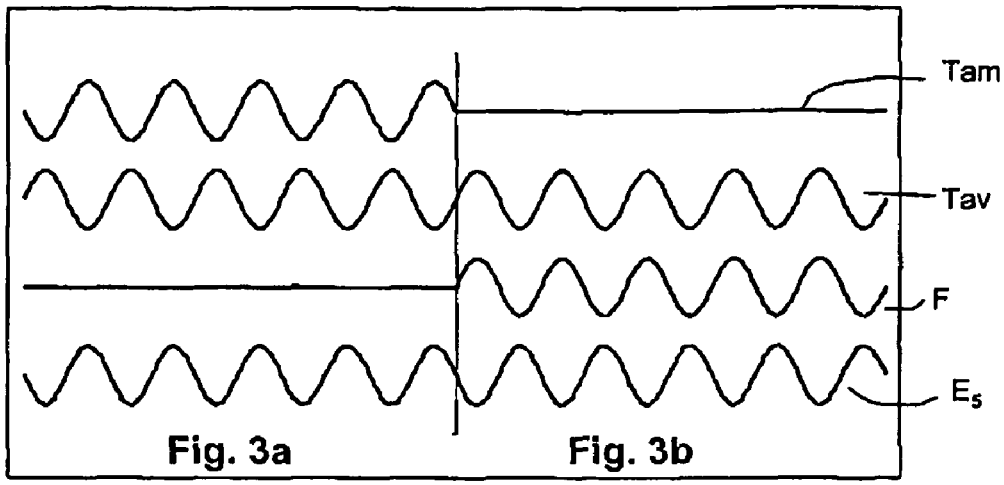
FIG. 3 shows the effect of a compensation according to the prior art.

The stands can be equipped with eccentricity compensation according to conventional mode, and, for example by following the teaching of patent FR 2 735 046, the eccentricity defects of stand 2 are measured by the upstream tensiometer $T_{12}$ and a compensation signal is created by Fourier analysis or any other method for extracting a signal corresponding to the rotation frequency of the rolls of stand 2. FIG. 3 shows what is then seen. FIG. 3*a* shows the mode without compensation. The traction signal upstream of the stand generating a defect $T_{am}$, the traction signal $T_{av}$ downstream of the stand generating a defect are shown successively. These two traction signals are affected by a cyclic perturbation of sinusoidal appearance and in phase opposition. The force F is kept constant by the control, and does not change, while the thickness at exit of the stand in question and the final exit thickness $E_5$ are affected by the perturbation.

Of course, to make these observations, in the present case linked to eccentricity defects of the working rolls, it was necessary to reduce the speed of the rolling mill, or better, to take a non filtered signal from the thickness gauge, because, as already said, these defects are in general invisible at normal rolling speeds since they are masked by the filtration devices of the thickness measuring gauges. These are residual defects, mainly due to the circularity defects of the working rolls (11, 12, 21, 22, . . . ). They are present in spite of placing eccentricity compensation of conventional type, they thus correspond to a novel mode of transfer of the mechanical defects of a stand in default of the thickness of the strip (B). In fact, if an attempt is made to eliminate them with a compensation of conventional type the result is surprising.

FIG. 3*b* shows the result obtained by classic compensation mode of the eccentricity defect. The upstream traction $T_{am}$ is stabilised since the measure of this signal is used as error signal, whereas the rolling force F is perturbed by the correction signal, since it is applied to the clamping means of the rolling mill stand. By comparison, and surprisingly, the exit thickness $E_5$ undergoes no modification and always has the same defect, as well as the traction downstream at the rolling mill stand Tav. We are thus presented with a defect not accessible by modification of the force of the stand to be corrected, rather by a defect propagated by tractions, a 'horizontal mode' defect.

Therefore, and according to the method of the invention, a 'horizontal mode' defect generated by a stand i is corrected by action on at least one downstream stand of row at least i+1. Such a defect can also be corrected on the last stand. In fact, the law of flow made it possible to determine a law of thickness control of "mass flow" type which can be written for the entire mill:

$$V_1e_1=V_5e_5 \quad (1).$$

If it is considered that the thickness e is the sum of the nominal thickness E and of a perturbation Δe according to (1) it can be written:

$$V_1(E_1+\Delta e_1)=V_5(E_5+\Delta e_5) \quad (2)$$

Resulting in: $V_1E_1=V_5E_5$ (3)

This equation shows that the AGC control ensures that the nominal value of the thickness $E_5$ is obtained.

But also: $V_1\Delta e_1=V_5\Delta e_5$ (4) which shows that the thickness perturbations are also transmitted by the speeds/tractions (horizontal mode').

Of course, a defect of 'vertical mode' generating downstream of the stand from where it originates ; a defect of 'horizontal mode' by its influence on the tractions could also be corrected on a stand downstream of that which generates it, or even on the last stand of the tandem rolling mill.

Since it is known that action on clamping an intermediary stand modifies the upstream and downstream tractions present on either side of this stand, it is possible to find compensation means of the defects of 'horizontal mode' by action on the clamping of a stand placed downstream of that from where the defects originated. In the method of the invention, to compensate a cyclic defect of the thickness a compensation signal will be generated and applied ('vertical mode') to the clamping of a stand downstream and in phase opposition with the incident defect.

Figure 4:
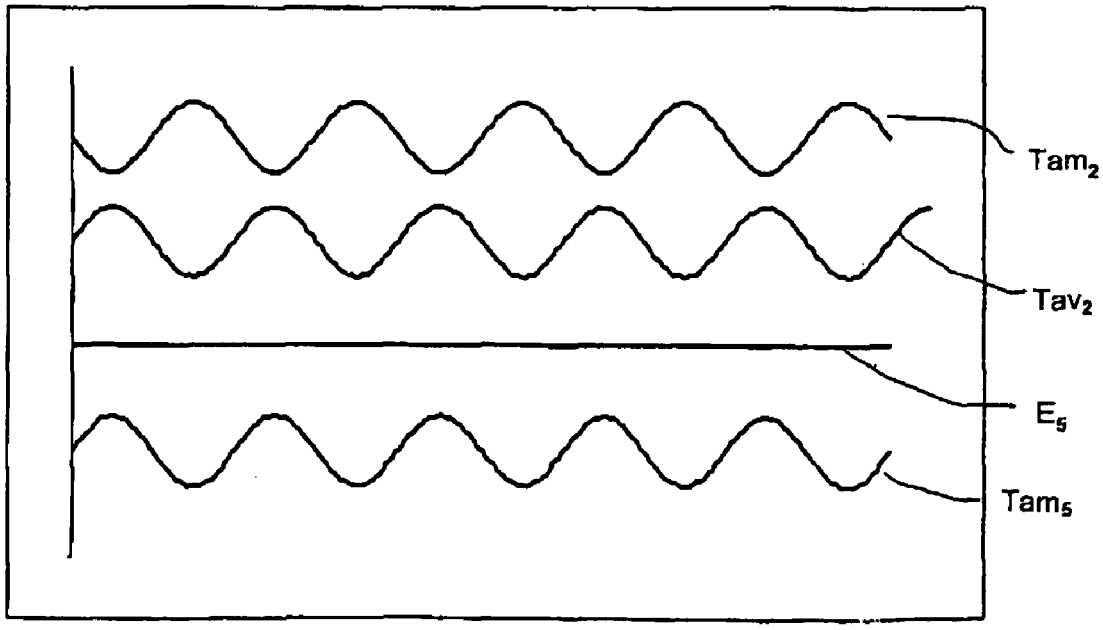
FIG. 4 schematically shows the effect of a compensation according to the invention.

The effects of this novel mode of compensation action are shown in FIG. 4. A signal extracted from the exit thickness signal $E_5$ is tuned to the rotation frequency of the rolls of the stand exhibiting a defect (here, stand 2) is applied to control of the clamping of the last stand 5. The tractions upstream and downstream of the stand 2, $T_{am2}$ and $T_{av2}$C remain perturbed as when there were no compensation. The effect of the compensation applied to stand 5 results in a perturbation on the traction upstream of stand 5 $T_{am5}$ and a stabilised exit thickness $E_5$.

It is interesting to note here a property of the invention concerning the turning of the compensation regulator on the frequency of the stand of which the defects must be compensated. The frequency of the defects of the stand to be compensated is linked to the rotation speed of the rolls and the period of the thickness defect produced in the strip is P. If compensation is made on the last stand, or on a downstream stand, the rolled strip B will have undergone elongation A and the period will have become P*A. But at the same time the speed of the strip will have been multiplied by A, which causes the frequency of the defect V*A/P*A=V/P to be unchanged and still to correspond to that of the rotation speed of the motors of the stand of which the defects must be compensated.

Therefore, throughout its numerous assays the applicant made simulations to confirm the reality of the phenomena, of which the results are shown in FIG. 5. A 'horizontal mode' defect was simulated on stand 3 by superposing on the speed command of the motor of this stand a parasitic oscillation of sinusoidal appearance. Influences on the upstream traction $T_{23}$ show up immediately. FIG. 5*b* shows the defects generated by the simulation, out of compensation, and FIG. 5*a* shows the effects of the method of the invention. Without compensation, it is noted that the exit thickness $E_5$ is highly perturbed by the signal used for simulation. In FIG. 5*a* a compensation signal created from the exit gange $J_5$, tuned to the rotation frequency of the rolls of stand 3 generating the defect, is applied by the regulator to the clamping means of the stand 4, by adjusting its amplitude and its phase. What was previously estimated theoretically is immediately noted, specifically:

- the clamping S4 is perturbed (compensation acts on stand 4)
- because of this the perturbation appears on the inter-stand traction $T_{34}$.
- The law of flow, and the actions in phase opposition at the level of stand 4 cause the exit thickness $E_5$ to stabilise.

According to the method of the invention cyclic residual defects of the 'horizontal mode' type can thus be compensated by acting on the clamping means of a stand situated downstream of the stand which generates these defects. In practical terms, compensation is performed on a stand equipped with hydraulically controlled clamping means. The choice of stand on which the compensation method will be installed also depends on the number and place of the available gauges. According to a preferred embodiment of the invention, compensation of the cyclic defects will be installed the most immediately downstream of that generating the defects, on a stand equipped with a hydraulic clamping device, and equipped with a thickness-measuring gauge immediately downstream.

Therefore the device of the invention incorporates in a scheme of control of the thickness of a rolling mill of AGC type a regulator of cyclic defects R, as shown in figure 2.

According to this illustration the regulator acts on the last stand of the tandem rolling mill by creating a compensation signal from the signal of the exit thickness gauge $J_5$. This regulator receives a signal of the frequency of each of the defects generating stands to tune on these frequencies and to extract from the gauge signal the component corresponding to the defect to be corrected.

FIG. 6 schematically shows the operating principle of the compensation circuit comprising a resonator. In numerous patents, such as the Stewart et al. patent U.S. Pat. No. 4,656,854, a Fourier transformer is used to extract the signal of false round from the thickness signal or from the traction signal. The drawback to this method is that it is not possible to make a real time application of the defect to be corrected. In fact, it is necessary to make acquisition of the signal over at least one period of the component representative of the defect, then to calculate the Fourier transform of this sample to obtain the amplitudes of the defect on all frequencies. Next, the compensation to be applied to cancel these amplitudes is calculated, and finally the inverse Fourier transform is performed to have the compensation signal to be applied to the rolls clamping control device, in synchronism with the rotation movement of the said rolls.

The inventive method utilises Fourier analysis without the necessity of calculating complete transform and inverse transform, resulting in a control device operating in real time. The Fourier theorem teaches that any periodic function can be represented in the form of a sum of a constant term and a sequence of sinusoidal functions of frequency f, 2*f*, 3*f*, etc. which we will illustrate by their pulses $\omega_0 t, \omega_1 t, \ldots, \omega_n t$. The amplitudes $a_n$ and $b_n$ of the harmonic n are given by formulas $a_n = \frac{1}{2}\pi f F \cos \omega_n t$ and $b_n = \frac{1}{2}\pi f F \sin \omega_n t$.

In general it is enough to resolve the problem of eccentricity defects of the rolling mill rolls to correct the defect corresponding to the fundamental frequency, that is, the rotation speed of the rolls. But it is also possible, due to the device of the invention to correct the harmonics 2, 3, etc.

The regulator R according to the invention is a Fourier analyser in real time, which functions like a control circuit. As shown in FIG. 6, the input signals are the thickness error signal $\Delta e$ and the pulse $\omega_n t$. The sine and cosine functions are realised in modules 100 and 101 and modules 102 and 103 realise the product by the function to be analysed: $\Delta e$.

Then appear the integration modules 104 and 105 which deliver at their exit the amplitudes $a_n$ and $b_n$ of the harmonic n to be corrected, which are then to be multiplied by the error signal $\Delta e$ and to be summed up in modules 106, 107 and 108 to create the correction signal c which will be applied to control of the hydraulic clamping device of the rolls of the rolling mill stand. Such a device runs without delay and progressively applies a correction signal at each change in the error signal $\Delta e$. It is a follower device, a resonator, which operates in real time. Of course, if there is need these circuits can be multiplied and other ones tuned on the harmonic frequencies 2*f*, 3*f*, etc. can be used. It is also useful to adjust these circuits in amplitude and in phase and the necessary circuits can be added in the regulator R between the input stage and that of the exit of the correction signal c. These techniques are familiar to the specialist and do not need to be described further here.

But the invention is not limited to the embodiment described; as is shown in FIG. 2 the defects of all the stands of the rolling mill can be compensated by action on the last stand starting from the signal of the exit thickness gauge. Yet other combinations are possible without going beyond the scope of the invention, according to the number of stands generating defects, the number of stands equipped with hydraulic clamping and the number of thickness gauges available, in which the defects generated by a stand of row i are corrected by action on a stand of row i+j situated downstream, on the condition that this stand is equipped with hydraulic clamping and that a thickness gauge is situated immediately downstream of said stand of row i+j.

It is also possible, without going beyond the scope of the invention, to correct other cyclic defects present in the rolled strip, originating, for example from hot rolling, provided that these defects can be measured by a thickness gauge and that their frequency can be detected as the strip B passes by.

The sole aim of the reference signs inserted after the technical characteristics mentioned in the claims is to facilitate comprehension of the latter and not limit their scope.

The invention claimed is:

1. A method for controlling a final thickness of a rolled product at an exit of a rolling mill comprising the steps of: operating in tandem at least two rolling mill stands equipped with adjustable clamping means of a set of rolling rolls, linking the mill to an automatic device for controlling an exit thickness and tension of the product in each space between two successive stands and to a general device for monitoring the speeds of the rolling mill stands, installing hydraulically controlled clamping means on at least a last stand, and compensating a thickness cyclic perturbation present in the product and likely to be measured on the rolling mill by action of a regulator tuned to a frequency of said cyclic perturbation on the hydraulically controlled clamping means of at least one stand situated downstream from the stand from which the cyclic perturbation originated.

2. The method for controlling the final thickness of a rolled product as claimed in claim 1, further comprising detecting the thickness cyclic perturbation to be compensated for using a thickness gauge.

3. The method for controlling the final thickness of a rolled product as claimed in claim 2, wherein said detecting step comprises detecting an origin of the thickness cyclic perturbation as mechanical defects of the stands of the rolling mill.

4. The method as claimed in claim 3, further comprising detecting eccentricity defects of the rolls of the rolling mill stands.

5. The method as claimed in claim 4, wherein said compensating step comprises compensating the eccentricity defects of the rolls of the stand of row i by an action of the regulating device on the hydraulic clamping of at least one stand situated downstream of said stand of row i.

6. The method as claimed in claim 5, wherein said compensating step comprises compensating the eccentricity defects of the rolls of the stand of row i by an action of the regulating device on the hydraulic clamping of the stand situated downstream of and closest to said stand of row i and for which there are hydraulically controlled clamping means and a downstream thickness gauge.

7. The method as claimed in claim 1, wherein said compensating step comprises compensating the product thickness cyclic perturbation caused by the eccentricity defects of the rolls of first stands of the rolling mill by an action of the regulating device on the hydraulic clamping of a last stand of said rolling mill.

8. The method as claimed in claim 1, wherein said compensating step comprises compensating the product thickness cyclic perturbation caused by the eccentricity defects of rolls of a last stand of the rolling mill by an action of the regulating device on the hydraulic clamping of said last stand of the rolling mill.

9. A device for controlling a thickness of a strip at an exit of a rolling mill comprising at least two stands operating in tandem, each said stand being equipped with adjustable clamping means for a set of rolling rolls, hydraulically controlled means on at least a last one of said stands, the rolling mill being linked to an automatic device for controlling an exit thickness and tension of the strip in each space between two successive stands, and to a general device for monitoring speeds of the rolling stands, and at least one compensation device for compensating thickness cyclic perturbations present in the rolled strip, acting in closed loop and in real time on the hydraulically controlled clamping means of at least one stand situated downstream from the stand from which the cyclic perturbations originated by forming a compensation signal from a signal from a thickness gauge.

10. The device for controlling the thickness of the strip as claimed in claim 9, wherein an origin of the strip thickness cyclic defects is mechanical defects of the stands of the tandem rolling mill.

11. The device for controlling the thickness of the strip as claimed in claim 9, wherein the at least one compensation device comprises a resonating circuit tuned to a frequency of a cyclic defect to be corrected.

12. The device for controlling the thickness of the strip as claimed in claims 9, wherein the compensation device for different cyclic defects comprise resonating circuits each tuned to a frequency of one of cyclic defects to be corrected.

13. The device for controlling the thickness of the strip as claimed in claim 9, wherein the compensation device for cyclic defects of a stand of row i act on the hydraulic controlled means of a first stand situated downstream of said stand of row i equipped with means for adjusting clamping of the rolling rolls, and a thickness gauge at an exit of said rolling stand situated downstream of said stand of row i.

14. The device for controlling the thickness of the strip as claimed in claim 9, wherein the compensation device of the cyclic defects of a set of first stands of the rolling mill all act on the hydraulic controlled means of a last stand of the rolling mill by utilising the signal of the thickness gauge at an exit of the rolling mill and comprise resonating circuits tuned to a frequency of the cyclic defect of each of the first stands of the rolling mill to be compensated.

15. The device for controlling the thickness of the strip as claimed in claim 14, wherein each resonating circuit comprises a Fourier analyser operating in real time on a fundamental frequency of the signal of the thickness gauge.

16. The device for controlling the thickness of the strip as claimed in claims 14, wherein there is provided a resonating circuit comprising a Fourier analyser operating in real time on a fundamental frequency of the signal of the thickness gauge and other resonating circuits each comprising a Fourier analyser operating in real time on each harmonic of the signal of the thickness gauge in a Fourier decomposition.

17. A rolling mill comprising at least two rolling mill stands operating in tandem, each stand being equipped with adjustable clamping means for a set of rolling rolls, the mill being linked to an automatic device for controlling an exit thickness and tension of a product in each space between two successive stands, and to a general device for monitoring speeds of the rolling mill stands, hydraulically controlled means on at least a last stand for clamping rolls and at least one compensation circuit for compensating thickness cyclic perturbations present in the rolled product, acting in closed loop on the hydraulically controlled clamping means of at least one stand situated downstream from the stand from which the cyclic perturbations originated.

18. The rolling mill as claimed in claim 17, wherein at least one exit thickness gauge provides a measure signal used by the compensation circuits.

* * * * *